US005475923A

United States Patent [19]

Ferraro

[11] Patent Number: 5,475,923

[45] Date of Patent: Dec. 19, 1995

[54] SEGMENTED GUARD BAR

[75] Inventor: Frank A. Ferraro, Trumbull, Conn.

[73] Assignee: Warner-Lambert Company, Morris Plains, N.J.

[21] Appl. No.: 957,490

[22] Filed: Oct. 7, 1992

Related U.S. Application Data

[63] Continuation of Ser. No. 732,294, Jul. 18, 1991, abandoned.

[51] Int. Cl.[6] ..... B26B 21/16

[52] U.S. Cl. ..... 30/51; 30/81

[58] Field of Search ..... 30/32, 48, 49–51, 30/81, 82, 346.5

[56] References Cited

U.S. PATENT DOCUMENTS

| | | | |
|---|---|---|---|
| 954,871 | 4/1910 | Molkenthin, Jr. | 30/82 |
| 1,247,266 | 11/1917 | Hartman | 30/3.48 |
| 1,768,307 | 6/1930 | Bleloch et al. | 30/81 |
| 1,927,971 | 9/1933 | Youmans | 30/48 |
| 2,750,663 | 6/1956 | Coles | 30/82 |
| 2,766,521 | 10/1956 | Benvenuti | 30/82 |
| 4,069,580 | 1/1978 | Cartwright et al. . | |
| 4,409,735 | 10/1988 | Cartwright et al. . | |
| 4,443,939 | 4/1984 | Motta | 30/81 |
| 4,516,320 | 5/1985 | Peleckis . | |
| 4,720,917 | 1/1988 | Solow | 30/49 |
| 4,754,548 | 5/1988 | Solow . | |
| 4,854,043 | 8/1989 | Chen | 30/49 |
| 4,976,028 | 12/1990 | Chen | 30/49 |
| 5,003,694 | 4/1991 | Chen | 30/32 |

FOREIGN PATENT DOCUMENTS

| | | |
|---|---|---|
| 300478A2 | 1/1989 | European Pat. Off. . |
| 2119690 | 11/1983 | United Kingdom . |

*Primary Examiner*—Richard K. Seidel
*Attorney, Agent, or Firm*—Charles W. Almer, III

[57] ABSTRACT

Segmented guard bar wherein segments of adjacent guard bars are tapered such that the skin flow through spaces between the segments is reduced. According to one preferred, illustrated embodiment, the distance between the rearward portion of adjacent segments is less than the space between the forward portions of those segments. Though not limited to any specific type of razor, the present invention is particularly suited for use with a flexible razor head having a cap member, at least one and preferably two blades separated by a spacer, a blade seat having a plurality of blade support portions separated by corrugations, and a segmented guard bar with each segment independently connected to the blade support portions.

18 Claims, 6 Drawing Sheets

SEGMENTED GUARD BAR

This is a continuation of application Ser. No. 07/732,294 filed on Jul. 18, 1991 now abandoned.

The present invention is directed to a guard bar for a safety razor and, more particularly, to a guard bar comprising a plurality of separate segments at least one of which is designed to minimize the flow of skin through the spaces between the segments.

In recognition of the fact that surfaces being shaved are not perfectly planar, a razor head comprising a cap, two blades separated by a spacer, and a guard bar have been designed such that the entire razor head flexes as a unit during shaving. In order to maximize the flexibility of the blade seat, one design includes a guard bar formed of a plurality of discrete segments. These segments are independently supported by the blade seat. Adjacent segments of the guard bar are thus separated by spaces. This segmented guard bar design has proven very successful in providing overall flexibility to the razor head without noticeable distortions to the blade geometry during shaving.

The consistent achievement of a close, safe and comfortable shave depends upon careful control of the blade geometry. To this end, the present invention is directed to further improvements in razor heads utilizing segmented guard bars.

Those skilled in the art appreciate that a guard bar, which is designed to be the first element of a safety razor to contact a given area during a shaving stroke, affects the manner in which the skin approaches the edge of the seat blade. During a shaving stroke, skin typically flows over a guard bar and into the space between the guard bar and seat blade some distance below a tangent drawn from the top of the guard bar to the blade edge. The degree to which skin may flow below such a tangent line depends upon the seat blade span, i.e. the distance between the guard bar and seat blade edge.

Though the spaces between segments of a segmented guard bar have been designed to minimize the amount of skin which is not actually contacted by the guard bar segments during a shaving stroke, variations in the skin flow may still result. The skin flowing through the spaces between the segments may contact the seat blade edge at a different angle than the skin flowing over the guard bar segments. Additionally, when a flexible razor head having a segmented guard bar flexes in response to forces encountered during shaving, the space between at least some of the segments increases. This space increase further increases the possibility of a non-uniform skin flow immediately forward of the forward blade. A non-uniform skin flow may adversely affect the comfort of the shave.

It would therefore be desirable to provide greater skin flow control to a segmented guard bar to further minimize and preferably eliminate potential variations in skin flow over a segmented guard bar and thereby provide better control of the blade geometry during shaving.

SUMMARY OF THE INVENTION

The present invention is directed to a segmented guard bar with improved skin flow control. According to one illustrated embodiment, the space between the rearward portion of adjacent segments is less than the space between the forward portions of those segments. According to a second illustrated embodiment, the space between guard bar segments is disposed at an angle to the direction of shaving thereby preventing the unobstructed flow of skin through the space as the skin approached the forward blade. Still further embodiments of the present invention include lateral extensions positioned on the sidewalls of guard bar segments in order to minimize or block the flow of skin through the spaces. Though not limited to any specific type of razor, the present invention is particularly suited for use with a flexible razor head having a cap member, at least one and preferably two blades separated by a spacer, a blade seat having a plurality of blade support portions separated by corrugations, and a segmented guard bar with each segment independently connected to the blade support portions.

DETAILED DESCRIPTION

For purposes of illustration, the present invention has been illustrated and will be described herein in conjunction with a flexible razor head. As used herein, the term "razor head" is meant to include both razor cartridges adapted to be utilized with a separate handle, and the upper, operative elements of a disposable razor to which a handle is permanently attached. For ease of explanation, the present invention is described herein as a disposable cartridge adapted for attachment to a separate razor.

Figure 1:
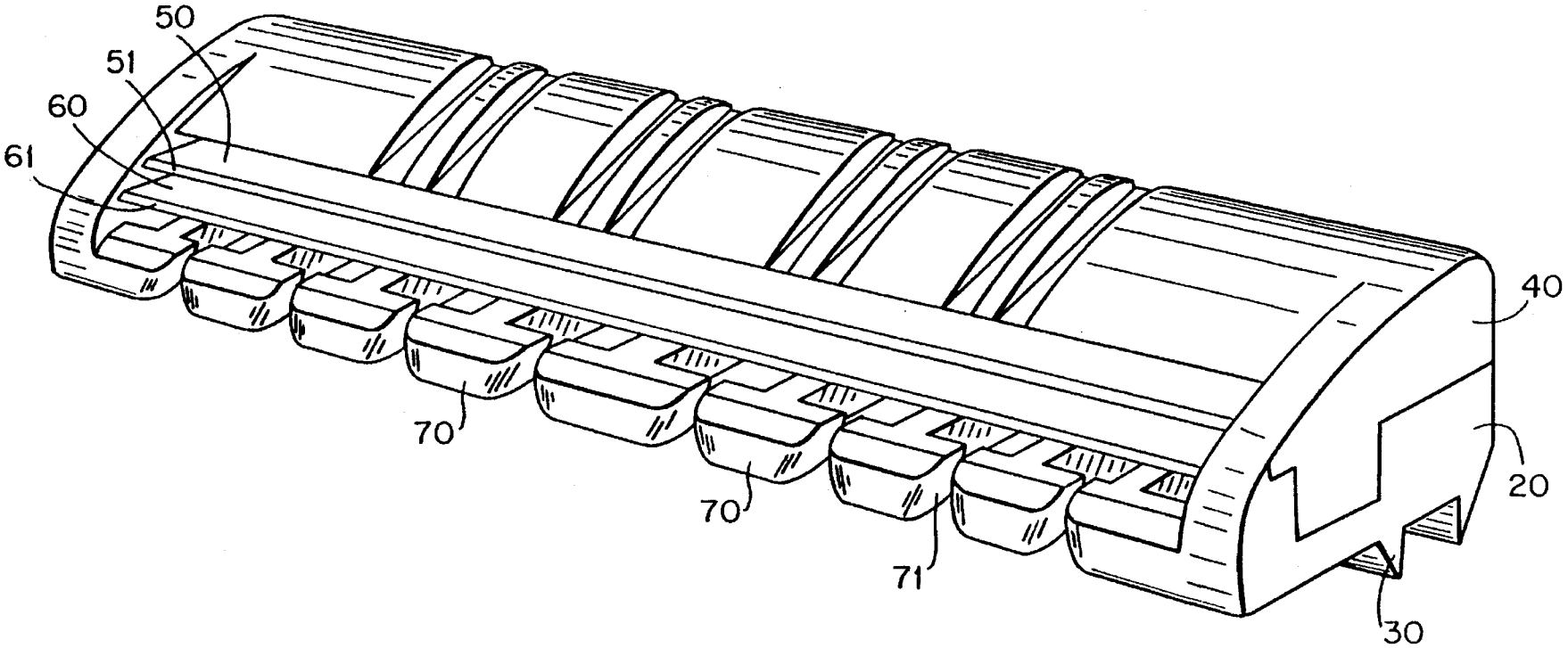
FIG. 1 is a perspective view of a razor head of one embodiment of the present invention.
Figure 2:
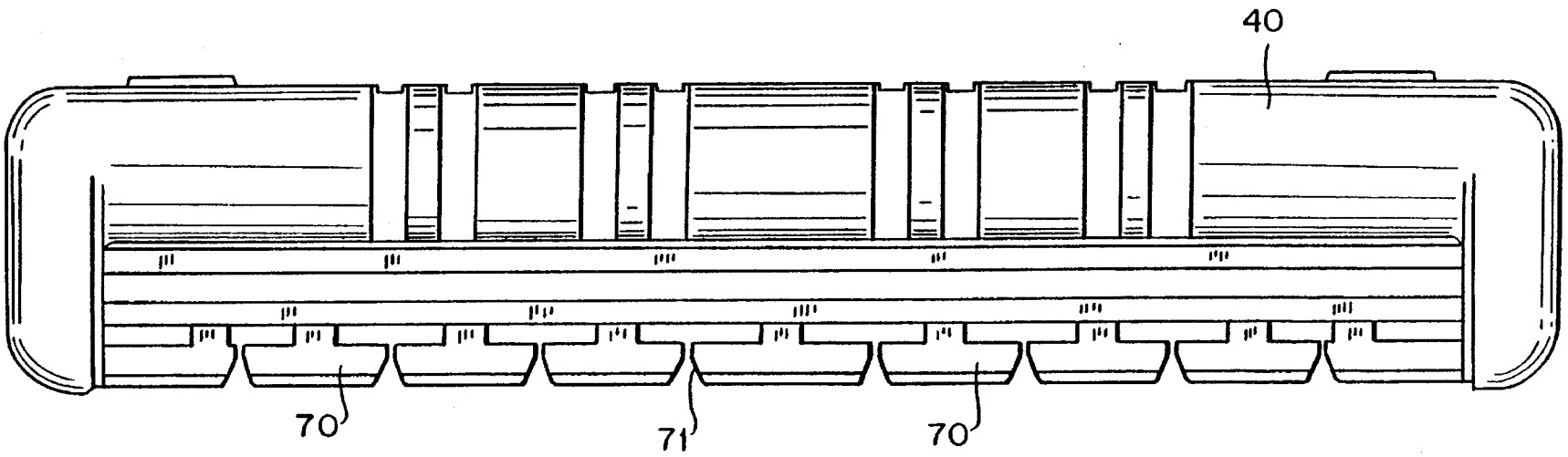
FIG. 2 is a top view of the razor head illustrated in FIG. 1.
Figure 3:
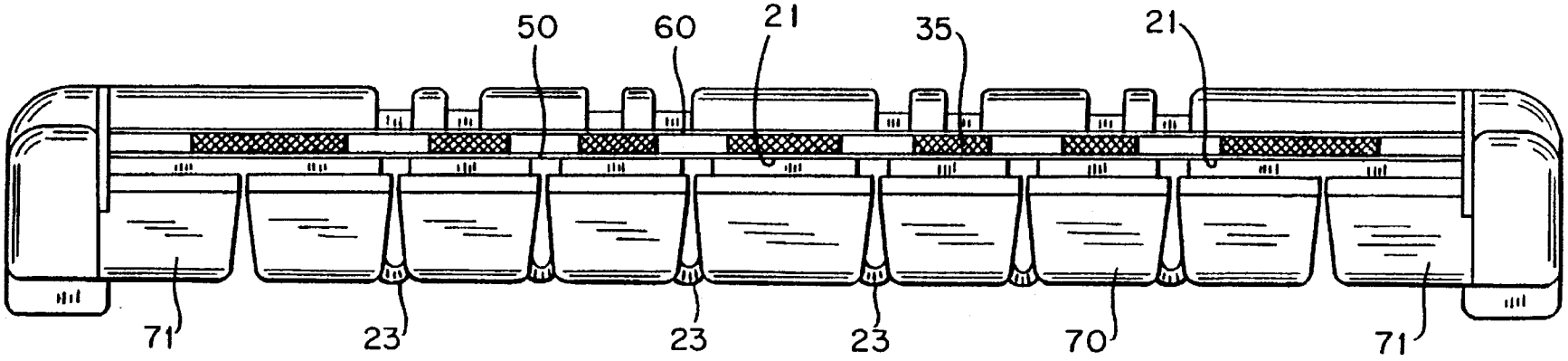
FIG. 3 is a front view of the razor head illustrated in FIG. 1.
Figure 4:
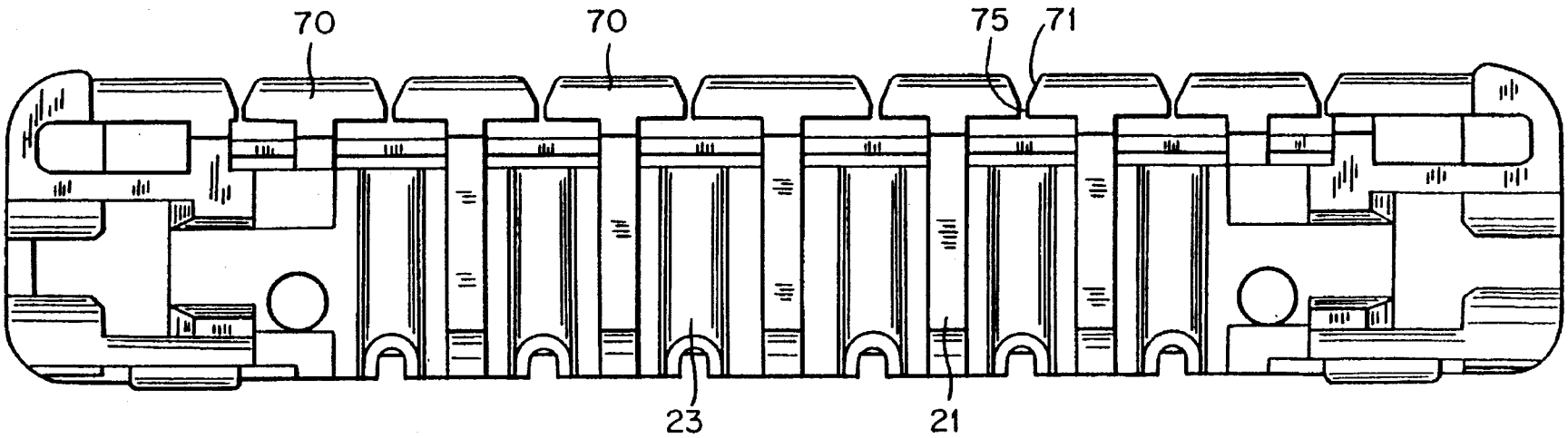
FIG. 4 is a bottom view of the razor head illustrated in FIG. 1.
Figure 5:
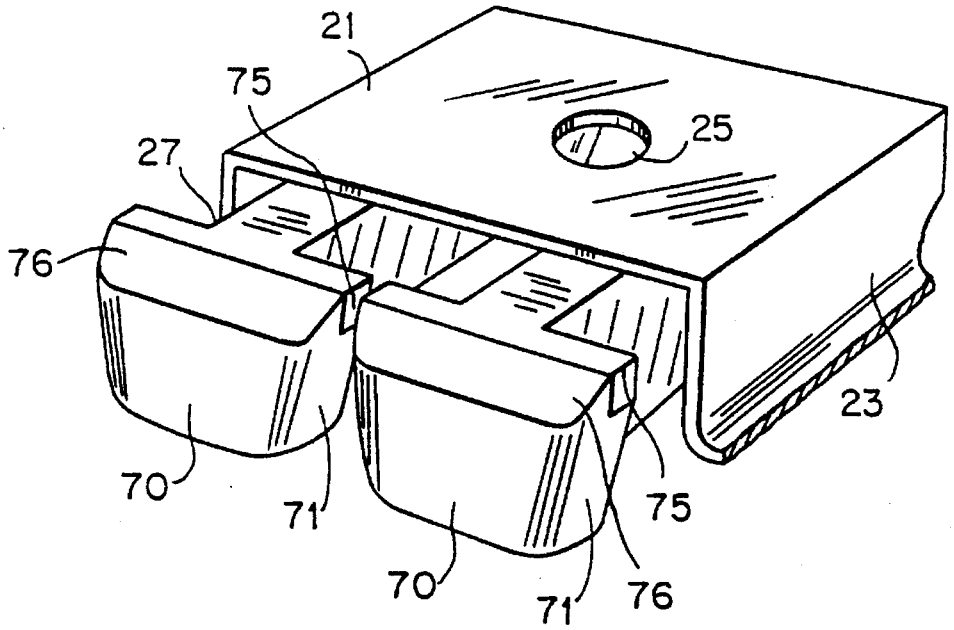
FIG. 5 is an enlarged perspective view of a portion of a blade support and guard bar of the embodiment of the present invention illustrated in FIG. 1.

FIG. 1 illustrates a razor head of one embodiment of the present invention having a blade seat 20, attachment members 30, a cap member 40, a cap blade 50 having sharpened edge 51, a seat blade 60 having sharpened edge 61, and a guard bar comprising a plurality of segments 70. The manner of connecting the various elements may be with the use of pins as disclosed in U.S. Pat. No. 4,854,043 to Chen, which is hereby incorporated by reference. Other methods are also suitable without departing from the scope of the present invention. For example, the cap 40, blade support 20, blade spacer 35, and segmented guard bar may also be integrally formed around one or more blades by an insert molding process.

The present invention provides greater skin flow control than previously disclosed segmented guard bars by increasing the control of skin through the space between adjacent segments. The skin flow control members of one illustrated embodiment are best understood with reference to FIGS. 1–5. As illustrated, blade seat 20 is integrally formed with a plurality of blade supports 21 separated by corrugations 23 and having holes 25 adapted to receive locking pins of cap member 40. The guard bar segments 70 are individually supported by blade supports 21 via connectors 27, with the exception of end segments 71 which are integrally formed with the sidewalls of blade seat 20 and attachment members 30.

Greater skin flow control is provided to the segmented guard bar by this embodiment of the present invention by providing at least one of the guard bar segments 70 with a tapered portion 71 and by reducing the space between adjacent segments 70. The tapered portion in the illustrated embodiment is advantageously formed to provide a smaller space between the rearward portion of the guard bar segments than the respective forward portions. According to the illustrated embodiment, each segment 70 is preferably tapered both laterally and rearwardly thereby providing a smooth transition between the forward and rearward portions of adjacent guard bar segments. While the angle of these tapers may vary without departing from the scope of the present invention, suitable angles include about 3 to 15 degrees.

As shown in the illustrated embodiment, the segments are preferably provided with a non-tapered, substantially vertical portion 75. This portion is preferably disposed in the upper, rearward portion of the segment 70 and has a space of sufficiently narrow width to substantially eliminate the unobstructed flow of skin therethrough. For example, the distance between the non-tapered portion 75 of adjacent guard bar segments 70 may be about 0.003–0.015 inches, most preferably about 0.005 inches.

According to the embodiment of the present invention illustrated in FIGS. 1–5, each guard bar segment 70 is also provided with an inclined surface 76 extending from the forward face to the upper surface of the guard bar segments. Inclined surface 76 is designed to provide a smoother feel to the shaver when the razor head is disposed at an angle to the skin surface.

Figure 6:
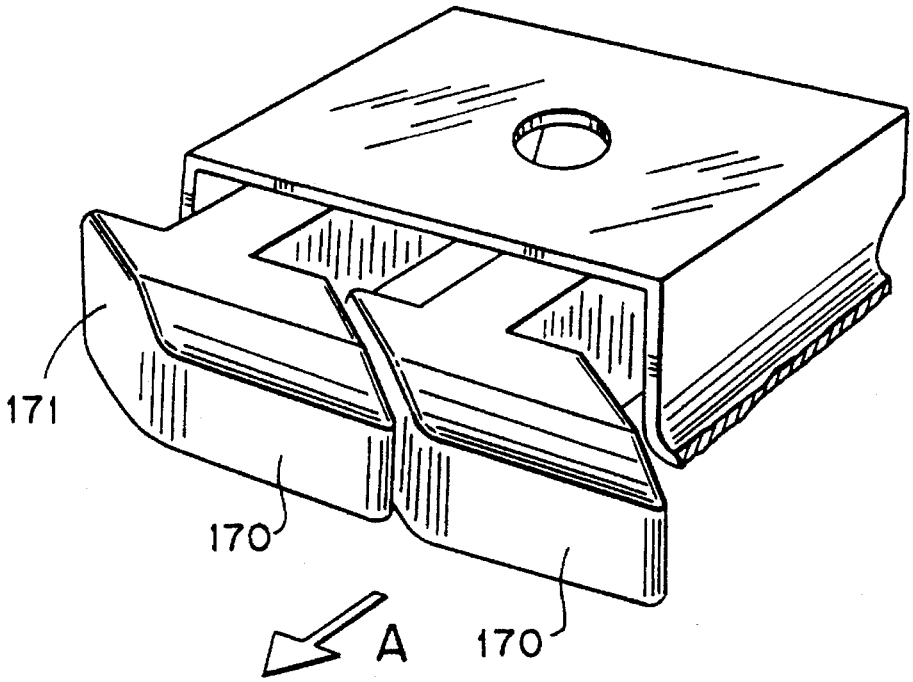
FIG. 6 is an enlarged perspective view of a portion of a blade support and guard bar of a second embodiment of the present invention.

FIG. 6 illustrates two guard bar segments 170 of an alternative embodiment of the present invention. In the matter illustrated, the sidewalls 171 are disposed at an angle to the direction of shaving which is illustrated by arrow A in FIG. 6. From the illustration and the description herein, those skilled in the art will appreciate that an area being shaved will not be permitted to flow unobstructed through the space between adjacent segments 170 in light of the angle of sidewalls 171 relative to the direction of shaving. While this embodiment of the present invention has relatively planar sidewalls, the sidewalls may be designed such that the space is not only disposed at an angle to the direction of the shaving stroke, but so that the space also tapers rearwardly to provide a narrower space at the rearward portion of the segments then at the respective forward portions.

Figure 7:
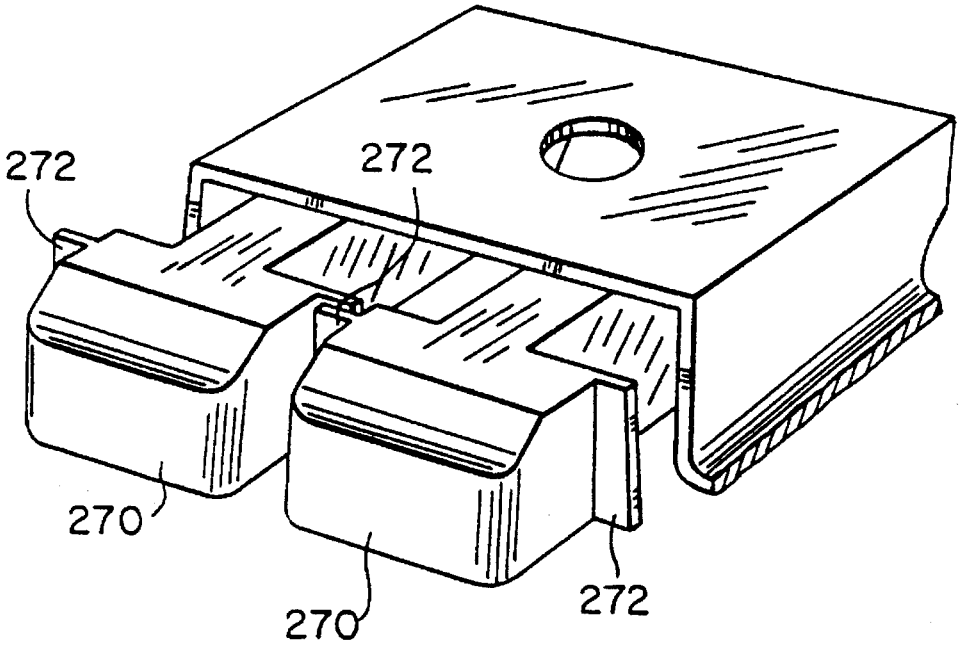
FIG. 7 is an enlarged perspective view of a portion of a blade support and guard bar of a third embodiment of the present invention.

FIG. 7 illustrates a still further embodiment of the present invention Wherein adjacent guard bar segments 270 are provided with lateral extensions 272. The lateral extensions 272 of this embodiment of the present invention are designed to overlap, preferably without contacting each other, within the spaces between adjacent guard bar segments 270. Lateral extensions 272 are designed to prevent the unobstructed flow of skin through the spaces between adjacent guard bar segments 270.

Figure 8:
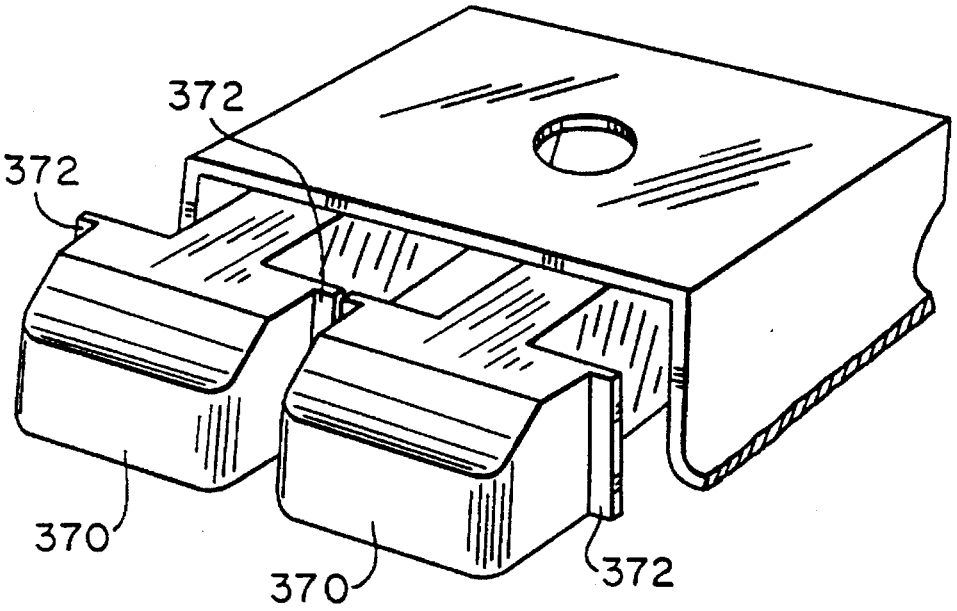
FIG. 8 is an enlarged perspective view of a portion of a blade support and guard bar segments of a fourth embodiment of the present invention.

FIG. 8 illustrates a still further embodiment of the present invention wherein adjacent guard bar segments 370 are provided with lateral extension 372 which are arranged in side-by-side relationship thereby significantly reducing the effective space between adjacent guard bar segments 370 to reduce the flow of skin therethrough. The space between lateral extensions 372 of adjacent guard bar segments may be about 0.003–0.015 inches, most preferably about 0.005 inches.

Lateral extensions, such as those illustrated in FIGS. 7 and 8, may also be utilized in combination with one or more of the embodiments described above on a single guard bar.

The present invention provides increased skin flow control in areas being shaved between the guard bar segments without reducing the relatively free movement between guard bar segments since the segments are preferably not directly connected.

While the Figures show preferred embodiments of the present invention, alternative embodiments may be made without departing from the scope of the present invention. For example, in order to practice the present invention it is not necessary that all of the segments are tapered. It may be desirable to provide tapers to only one or several of the guard bar segments.

By providing a guard bar formed of a plurality of independent segments, the present invention maintains the advantage of providing a flexible guard bar suitable for use with flexible razor heads.

What is claimed is:

1. A guard bar for use with a razor head comprising:

a plurality of segments disposed for engagement with a surface being shaved, said segments comprising a face engaging portion and a rearward portion, said segments being at least partially separated from adjacent segments thereby providing a space therebetween; and at least one of said segments comprising a tapered side portion for controlling the flow of skin through said space between said segments wherein said tapered side portion tapers rearwardly and laterally such that opposing portions of said segments are closer toward the rear of said segments than at the face engaging portions.

2. A guard bar according to claim 1 wherein said tapered side portion further comprises a substantially vertical portion.

3. A guard bar according to claim 2 wherein said substantially vertical portion is disposed at the top of said segment.

4. A guard bar according to claim 3 wherein at least one pair of adjacent guard bar segments comprise opposed tapered side portions.

5. A guard bar according to claim 4 wherein said. tapered side portions comprise vertical portions having a reduced space therebetween.

6. A guard bar according to claim 1 wherein at least one pair of adjacent guard bar segments comprise opposed tapered side portions.

7. A guard bar according to claim 6 wherein said tapered side portions comprise vertical portions having a reduced space therebetween.

8. A guard bar according to claim 7 wherein said reduced space is about 0.003–0.015 inches.

9. A guard bar according to claim 1 wherein at least two of said segments are separated by a distance of about 0.003–0.015 inches at the closest points of said segments.

10. A guard bar according to claim 9 wherein said distance is about 0.005 inches.

11. A guard bar according to claim 8 wherein said reduced space is about 0.005 inches.

12. A razor head comprising:

at least one blade having a sharpened edge;

a blade seat for supporting said blade;

a guard member comprising a plurality of segments disposed forwardly of said sharpened edge for controlling the flow of skin through at least one space between said segments, at least two of said segments being spaced by a distance of about 0.003–0.015 inches at the closest points of said segments for controlling the flow of skin through said space between said segments; wherein at least one pair of adjacent guard member segments comprise opposed tapered side portions and wherein said tapered side portion tapers rearwardly and laterally.

13. A guard bar for use with a razor head whereby said razor head is moved along a shaving path on a surface being shaved, said guard bar comprising:

a plurality of segments disposed for engagement with a surface being shaved; and at least two of said segments having a space therebetween defined by opposing sidewalls of said segments, wherein the entire height of each of said sidewalls is disposed at an angle to said shaving path and wherein said opposing sidewalls are separated by a distance of about 0.003–0.015 inches.

14. A guard bar for use with a razor head comprising:

a plurality of segments disposed for engagement with a surface being shaved, said segments comprising a face engaging portion and a rearward portion, said segments being at least partially separated from adjacent segments thereby providing a space therebetween; and at least one of said segments comprising a lateral extension which extends into said space thereby providing an obstruction to the flow of skin therethrough.

15. A guard bar according to claim 14 wherein at least two adjacent guard bar segments comprise lateral extensions disposed in side-by-side relation.

16. A guard bar according to claim 15 wherein said lateral extensions have a space of about 0.003–0.015 inches therebetween.

17. A guard bar according to claim 15 wherein said lateral extensions have a space of about 0.005 inch therebetween.

18. A guard bar according to claim 14 wherein at least two adjacent guard bar segments comprise lateral. extensions disposed in overlapping relation.

* * * * *